United States Patent [19]

Smith et al.

[11] Patent Number: 4,537,401

[45] Date of Patent: Aug. 27, 1985

[54] GAME APPARATUS

[76] Inventors: Roger D. Smith, 2705 S. Sunshine Dr., Lakeland, Fla. 33801; Harold J. Baer, 6597 Lake Elmo Ave., N., Stillwater, Minn. 55082

[21] Appl. No.: 564,564

[22] Filed: Dec. 22, 1983

[51] Int. Cl.[3] ..... A63B 67/14

[52] U.S. Cl. ..... 273/112; 273/113

[58] Field of Search ..... 273/86 C, 109, 110, 273/112

[56] References Cited

U.S. PATENT DOCUMENTS

| | | | |
|---|---|---|---|
| 591,234 | 10/1897 | Loring | 273/112 |
| 749,351 | 1/1904 | Arnold | 273/109 |
| 3,416,801 | 10/1968 | McKeown | 273/110 |
| 3,625,516 | 10/1971 | Handweller | 273/153 R |
| 3,735,923 | 5/1973 | Brigham | 273/86 C |
| 3,810,630 | 5/1974 | Gonzales | 273/153 S |
| 4,042,244 | 9/1977 | Kakovitch | 273/109 |
| 4,240,628 | 10/1980 | Brownfield | 273/1 R |
| 4,251,949 | 2/1981 | Buck | 273/86 C |

*Primary Examiner*—Richard C. Pinkham

*Assistant Examiner*—Benjamin Layno

*Attorney, Agent, or Firm*—Duckworth, Allen, Dyer & Pettis

[57] ABSTRACT

A game apparatus including a manipulatable container with a sinuous track having a concave surface mounted within the container and extending along a three dimensional path between a starting point and a finishing point, the track including a longitudinal twist between the start point and the finishing point. A ball rolls along the track as the game is manipulated by a user. The container may contain two compartments communicating with one another through an aperture.

27 Claims, 16 Drawing Figures

FINISH
START

GAME APPARATUS

BACKGROUND OF THE INVENTION

Many types of game apparatus requiring coordination and manual dexterity have long been popular. Among the popular forms of such games have been those in which the object has been the movement of a ball from one position of the game to another. Examples of this type of game are those involving a tilting board whose tilting in two orthogonal directions is controlled by a pair of knobs. Other examples are the small, hand-held devices in which a plurality of balls are moved into a pattern of depressions on the face of the game.

The features that have made these games popular are the manipulative skill required for success at the game and thus the challenge presented. Most of the games of this type, in which a ball is moved along a path, have utilized only two-dimensional movement of the ball, although a few have utilized a plurality of two-dimensional paths with the ball dropping from one two-dimensional path to another. The challenge of such a game could be enhanced significantly if the structure required continuous movement along a fully three-dimensional path.

SUMMARY OF THE INVENTION

In view of the foregoing desirable features of the type of games in which a ball is moved over a predetermined path, it is an object of this invention to provide such a game that requires skill and coordination. It is an additional object of this invention to provide such a game in which a ball is moved along a fully three-dimensional path. It is a further object of this invention to provide such a game apparatus that requires three-dimensional manipulation to move the ball from a starting point to a finishing point without falling from the path.

To achieve the foregoing, plus additional objects that will become apparent from disclosure that follows, a game apparatus is disclosed that comprises a container having a first compartment and a sinuous track within such compartment having a concave surface of predetermined width and depth and describing a three-dimensional path extending between two points defined as a starting point and a finishing point. The track is twisted longitudinally between the starting point and the finishing point such that a line prependicular to the rack surface at its maximum depth at one point along the track extends generally perpendicular to the direction of a similar line at another portion of the track, and a ball of predetermined diameter is adapted to be received onto the concave portion of the track and to roll along that track.

According to one preferred embodiment of this invention a receiving device is positioned adjacent the track finishing point to receive the ball from the track, with an aperture provided through a wall of the compartment communicating with the receiving device so that a ball received from the finishing point of the track may be passed through the aperture and out of the compartment. Additional embodiments of the apparatus include arrangements having plural tracks within the container with such plural tracks either both being within the same compartment or in separate compartments communicating with one another through an aperture in a compartment wall, and apparatus in which are provided various obstacles to passage of the ball along the track.

BRIEF DESCRIPTION OF THE DRAWINGS

Several particularly preferred embodiments of the apparatus of the present invention are disclosed, in which.

DESCRIPTION OF PREFERRED EMBODIMENTS

Figures 1, 2, 3, 4, 5, 6, 7, 8, 9, 10, 11, 12, 13, 14, 15, 16:
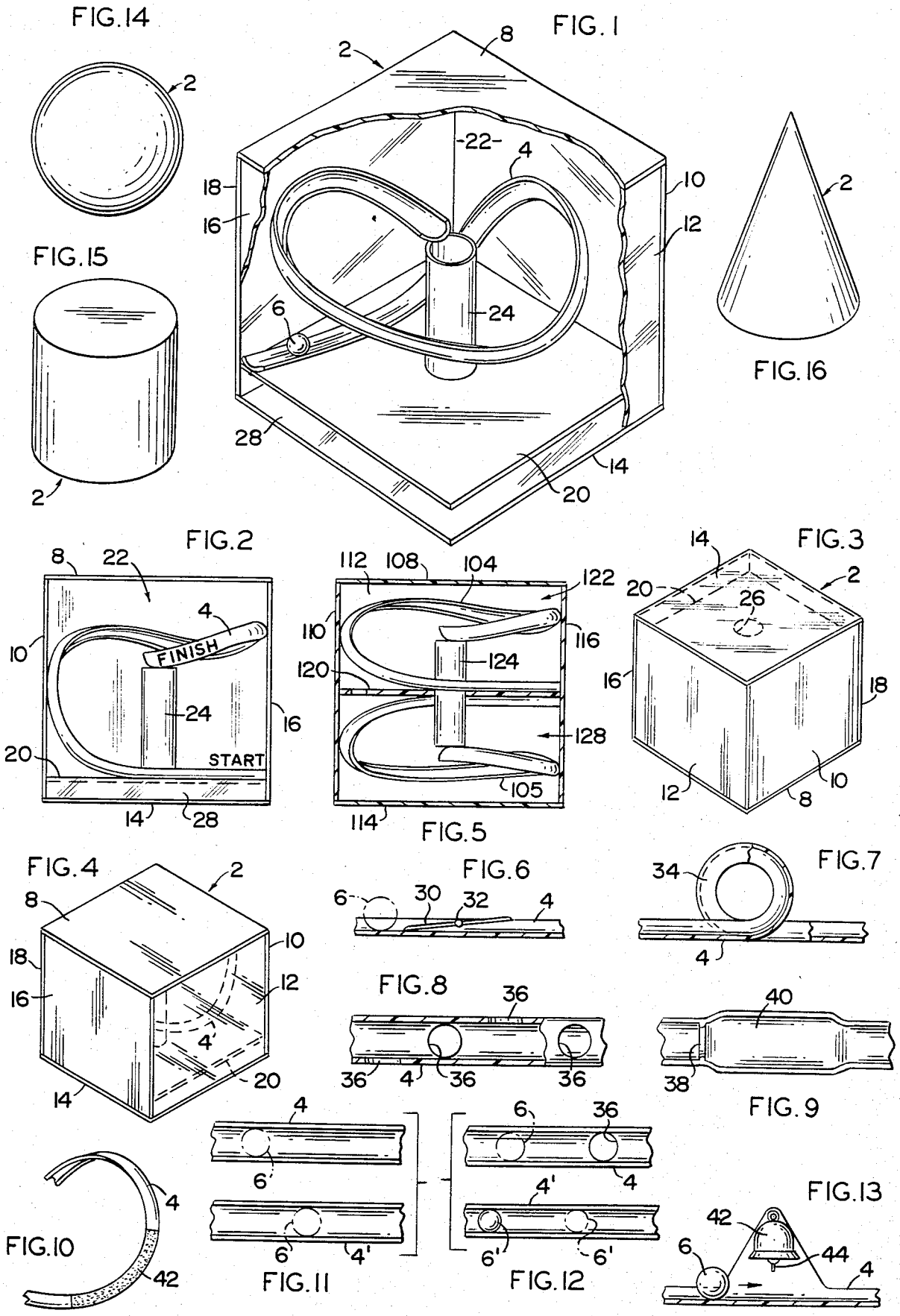
FIG. 1 is a perspective view, partially in section, of a preferred embodiment of the present invention.
FIG. 2 is a side elevation of the apparatus of FIG. 1.
FIG. 3 is a perspective view of the apparatus of FIG. 1 in an inverted orientation.
FIG. 4 is a perspective view of a variation of the apparatus of FIGS. 1 through 3, illustrating an arrangement of transparent and opaque container sides.
FIG. 5 is a side-sectional view of a variation of the apparatus of FIG. 1, comprising two separate compartments, each having a separate sinuous track.
FIG. 6 is a side-sectional view of a portion of the sinuous track of the apparatus of FIGS. 1 or 5, illustrating a pivoting obstacle placed along said track.
FIG. 7 is a side-sectional view of portion of the sinuous track of the apparatus of FIGS. 1 or 5, illustrating a loop in such track.
FIG. 8 is a top-sectional view of a variation of a portion of the sinuous track of the apparatus of FIGS. 1 or 5 in which that portion of the track is of tubular configuration with an aperture therethrough.
FIG. 9 is a top view of a portion of a variation of the sinuous track of the apparatus of FIGS. 1 or 5 illustrating another form of obstacle placed along the track.
FIG. 10 is a fragmentary side view of a variation of the sinuous track of the apparatus of FIGS. 1 or 5 in which a portion of the track is made of a flexible, resilient material.
FIG. 11 is a fragmentary top view of a variation of the track of the apparatus of FIGS. 1 or 5 in which there are provided within the compartment a pair of tracks.
FIG. 12 is a top view of a variation of the apparatus of FIG. 11 in which the two tracks are of different sizes, with two balls of different sizes provided.
FIG. 13 is a side-sectional view of a portion of the sinuous track of the apparatus of FIGS. 1 or 5 illustrating the provision of a signal that is sounded by the passage of a ball thereby.
FIG. 14 represents a variation of the apparatus of FIG. 1 in which the container is generally spherical.
FIG. 15 is a perspective view of a variation of the apparatus of FIGS. 1 or 5 in which the container is generally cylindrical.
FIG. 16 is a perspective view of a variation of the apparatus of FIGS. 1 or 5 in which the container is of generally conical configuration.

One preferred embodiment of the game apparatus of this invention is illustrated in the prespective view, partially in section, of FIG. 1, the side-elevation of FIG. 2 and the inverted perspective view of FIG. 3. The game apparatus generally comprises a container 2, having within it a sinuous track 4 along which may roll a ball 6.

Container 2, which may be of a polyhedral shape, or of the configuration of a geometric solid of revolution, or other convenient configuration, is illutrated in FIG. 1 as being a cube, having side panels 8, 10, 12, 14, 16 and 18. This container may be fabricated of any suitable material, such as a rigid synthetic resin, and may be manufactured either by molding or by assembly of appropriate panels, as desired. Within the container 2 and, suitably, parallel to bottom 14, is provided a panel 20 intersecting sides 10, 12, 16 and 18.

The volume enclosed within the portion of container 2 defined by top and the side panels 8, 10, 12, 16 and 18, and panel 20, is defined as a first compartment. Within that first compartment is located the track means 4, suitably is in the form of the sinuous track illustrated. This track 4 suitably provided with a concave surface of predetermined width and depth. The track 4 curves sinuously about, describing a three-dimensional path extending between a starting point, such as adjacent the intersection of sides 16 and 18 and panel 20 in FIG. 1, and a finishing point, such as adjacent the mouth of receiving tube 24 in FIG. 1. As is shown in FIG. 2, as well as in FIG. 1, the sinuous track 4 not only describes a three-dimensional path but also includes a longitudinal twist along the track between the starting point and the finishing point such that a line perpendicular to the track surface at its maximum depth at one point along the track extends in a direction generally perpendicular to the direction of a similar line at another point along the track, as illustrated in FIGS. 1 and 2. This longitudinal twist is provided to require that the game, in operation, not only be tilted to move the ball 6 along the track 4 but also be rotated to prevent the ball 6 from falling from the track 4 as it rolls along that track.

Adjacent the finishing point of the track 4 is provided appropriate receiving means, such as the tubular member 24 in FIG. 1, extending from that track finishing point to a side of the compartment, such as the panel 20. An aperture 26 is provided through the panel 20 in communication with the interior of the tubular member 24. Both the tubular member 24 and the aperture 26 are dimensioned such that a ball received by the member 24 from the track finishing point can pass through the aperture to take the ball 6 out of the first compartment and, in this embodiment into a second compartment defined by panel 20, container bottom 14 and portions of the sides 10, 12, 16 and 18.

Although the entire structure of the container may be made of suitable transparent material, the operation of the game apparatus may be made more challenging by making portions thereof more or less opaque. For example, the container sides may be made either partially opaque or partially reflective, such that the interior may be viewed only with difficulty. Alternatively, at least one, and preferably several, or even all of the externally visible portions of the container may be made substantially opaque, such that the game must be manipulated by feel and sound only. The embodiment of FIGS. 1 through 3 could also be provided with all sides of the container substantially opaque except for the bottom panel 14. In this variation the bottom panel 14 and the panel 20 might suitably be left transparent such that a person manipulating the game could view it through those panels. Alternatively, as shown in FIG. 4, one of the other sides of the cube could be left substantially transparent.

If all of the external surfaces of the cube were to be made substantially opaque, another variation might be the printing of a representation of the sinuous track 4 on one or more sides of the cube, to give a user some idea as to the manipulation required for successful movement of the ball 6 along the full extent of the sinuous path 4. An additional variation of the game apparatus of this invention is illustrated in the side-sectional elevation of FIG. 5, in which the container is defined by sides 108, 110, 112, 114, 116 and 118 (not shown). In this embodiment the panel 120 divides the container into two compartments, 122 and 128, that may suitably be of approximately equal volume. Within the first compartment is included a first sinuous track 104 corresponding generally to track 4 in the embodiment of FIG. 1, the finishing point of which is adjacent the tubular member 124. Within the second compartment 128 is provided another sinuous track 105, the finishing point of which is adjacent the opposite end of tubular member 124, which member extends through the panel 120.

The embodiment of FIG. 5 may incorporate any of the various features of container opacity or transparentcy described above with respect to the embodiment of FIGS. 1 through 4. This embodiment provides, essentially, a two sided version of th game of FIG. 1. In addition to the variations of the basic invention illustrated in FIGS. 1 through 5, additional variations may be provided by the inclusion of different types of sinuous track within the container. Some of these variations are illustrated in FIG. 6 through 13.

FIG. 6 represents a portion of one of the sinuous tracks, such as those described above with respect to the reference numbers 4, 104, and 105, with the addition of an obstacle rendering movement of the ball 6 along the track 4 more difficult. In FIG. 6 the obstacle is illustrated as comprising a pivoting member 30 extending transverse to a portion of the track 4, with the pivot axis 32 of the pivoting member 30 transverse to and intersecting the track 4, so that a ball rolling along the track must roll up and over that pivoting member 30. Obviously, when the ball is rolling up and over the pivoting member 30, it is no longer held as firmly within the concave track as when on other portions of that track.

FIG. 7 illustrates another variation in which a portion of the track 4 is provided with a looped portion 34 around which the ball must roll prior to moving further along the track 4. In FIG. 8 is illustrated a variation of the track 4 in which, in a portion of the track, the concavity thereof is extended fully around the track to create a tubular portion of the track. This tubular portion is then provided with one or more apertures 36 therethrough. These apertures 36 may suitably be circular and of slightly greater diameter than the diameter of the ball 6, such that the game apparatus and thus the tubular track portion must be oriented with each aperture 36 facing slightly upwardly as the ball 6 passes thereby to prevent its falling through the aperture. To provide additional challenge, a plurality of such apertures 36 may be provided, positioned at different radial points about the tubular track portion 4 at different places along that track.

In FIG. 9 is illustrated another track portion variation in which an obstacle 38 is placed on the track to prevent free rolling of the ball 6 past the obstacle. This obstacle 38 thus requires the user of the game apparatus to cause the ball to "hop" over that obstacle to continue its movement. Because such "hopping" would make more likely the falling of the ball from the track, an enlarged track portion 40 is provided immediately past the obstacle 38 and between that obstacle 38 and the finishing point of the track. The ball may thus be more easily caught in that enlarged portion 40.

FIG. 10 illustrates a fragment of the track 4 with yet another variation in the form of a section 42 of the track being formed of a nonrigid elastomeric material that is flexible under the weight of the ball passing along the track. Thus, when the ball passes along that nonrigid portion 42, its weight may effect substantial deflection of that track portion, thus adding an additional challenge to the game.

FIG. 11 illustrate a fraction of the sinuous track arrangement of another variation of the apparatus of FIG. 1 in which a second sinuous track 4' is also provided within the first compartment 22. This second sinuous track 4' likewise has a concave cross section and describes a three-dimensional path extending between two points defined as a second starting point and a second finishing point. Suitably, the first and second starting points may be different with both finishing points being adjacent the tubular member 24. Thus, a ball 6 within that first compartment may roll along either of the two tracks.

As a further variation, FIG. 12 illustrates the use of two such tracks 4 and 4' but with the transverse width of the second track 4 being less than the transverse width of the first track 4. In this variation there also are provided two balls 6 and 6' with the radius of ball 6 generally corresponding to the concavity of track 4 and the radius of ball 6' generally corresponding to the concavity of track 4'. Thus, the second track 4' will provide less support transversely of the track to the first ball 6 than does the first track 4, or than the second track 4' provides to the smaller diameter second ball 6'. Because of this difference in transverse support the first ball 6 will fall more easily from the second track 4' than from the first track 4 and more easily than the second ball 6' falls from either track 4 or 4'. To provide additional challenge, track 4 may be provided with an aperture 36 slightly smaller than the diameter of ball 6. Thus, ball 6 can roll along track 4 past aperture 36 without falling therethrough. However, if the smaller ball 6' were moved along track 4, it would fall through the aperture 36, although it would move readily along track 4'. Obviously, aperture 36 could also be made slightly larger than the diameter of ball 6 so that the ball 6 would have to be moved rapidly past the aperture 36 to prevent falling therethrough.

FIG. 13 illustrates a fragment of track 4 of yet another variation, which is particularly suitable for use with the game apparatus having a generally opaque container. In this variation a signal 42, which may suitably be a bell, is supported adjacent the track 4. Actuating means, such as clapper 44, are further positioned adjacent the track in such a manner that movement of the ball 6 along the track will contact the actuating means 44 and provide the desired audible signal indicating the passage of the ball 6 past that point in the track.

Variations of the configuration of container 2 are illustrated in FIGS. 14, 15 and 16. Each of these configurations, instead of being of polyhedral configuration, such as that of FIGS. 1 through 5, is generally of the configuration of a geometric solid of revolution. In FIG. 14 the container 2 is shown as generally spherical; in FIG. 15 it is generally cylindrical, and in FIG. 16 the container 2 is illustrated as being of a generally conical configuration. Obviously, the various arrangements of transparent and opaque sides and the interior compartments described with respect to the embodiment of FIG. 1 may be incorporated in an analogous manner with these configurations as well.

The manner of use of the game apparatus of this invention may now be seen in connection with the various features described above. The object of the game is to move the ball 6 along the sinuous track 4 from the starting point to the finishing point so that it may be dropped into the receiving means 24. This is done by manipulating the container 2 to place the ball upon the track 4 adjacent the starting point and then manipulating the container, by rotating it as necessary about its three orthogonal axes in such a manner that the portion of the track 4 along which the ball 6 is moving at any moment is oriented with the concave portion facing upwardly. If the track includes any of the obstacles or variations of FIGS. 6 through 9, it will be necessary to manipulate the container 2 further to avoid or pass by those obstacles on the way to the finishing point. Where two tracks of substantially similar dimensions, such as in FIG. 11, are provided within the first compartment 22, the ball may be caused to move along either of those tracks. Where there are two tracks 4 and 4' of differing size and two differing balls 6 and 6', as with the variation of FIG. 12, it would be possible to manipulate either ball along either track, although there would be substantially less likelihood of the ball falling from the track corresponding to the size of that ball. Obviously, all of these manipulations are substantially increased in difficulty where the container is at least partially opaque.

Where the game apparatus is of the configuration illustrated in FIG. 5, the ball may be manipulated from the starting point of first track 104 to its finishing point, whereupon it drops through the tubular receiving means 124 into the second compartment 128. Then the game may be generally inverted and the ball moved along the second track 105 from its starting point to its finishing point, whereupon the ball may again fall through tubular receiving means 124 back into the first compartment 122, whereupon the entire sequence may be repeated, if desired.

Another variation of this apparatus may be formed by the elimination of the bottom panel 14, whereby the container has only the first compartment 22, such that movement of the ball along track 4 to the finishing point and into tubular receiving member 24 and then through the corresponding aperture in panel 20 will then release the ball 6 to the outside. This variation could be used in connection with a totally opaque cube in connection with a contest utilizing a plurality of such games with certain specially identified balls, or in which the first of a number of participants to free the ball from the container compartment is the winner.

While several particularly preferred embodiments of the game apparatus of this invention have been described and illustrated in detail, it is to be understood that these descriptions are merely illustrative of the principals of the invention and in no way limit the scope thereof. Accordingly, since numerous additional variations and modifications, incorporating the same or other suitable configurations and materials and all being within the scope of this invention, will readily occur to those skilled in the art, the scope of this invention is to be limited solely by the claims appended hereto.

What is claimed:

1. A game apparatus comprising a manipulatable container having a first compartment, said first compartment having a plurality of sides;

track means comprising a first sinuous track mounted within said first compartment and having a concave surface of predetermined width and depth said track beginning at a first starting point and ending at a first finishing point spaced from said first starting point and describing a three-dimensional path extending between said points, and said track including a longitudinal twist between said first starting point and said first finishing point such that a line perpendicular to said track surface at its maximum depth at one point along said track extends in a direction generally perpendicular to the direction of a similar line at another point along said track; and a first ball of predetermined diameter adapted to be received onto said concave surface of said track and to roll along said track means.

2. Game apparatus according to claim 1 further comprising receiving means positioned adjacent and past said first track finishing point to receive said ball from said track after said ball has rolled past said first track finishing point.

3. Game apparatus according to claim 2 wherein a side of said first compartment has an aperture therethrough, with said receiving means in communication with said aperture such that said ball received by said receiving means from said track finishing point can pass through said aperture.

4. Game apparatus according to claim 3 wherein said receiving means comprises a generally tubular member extending between said first track finishing point and the side of said compartment having said aperture.

5. Game apparatus according to claim 3 wherein said container includes a second compartment outside said first compartment and communicating with said first compartment through said aperture.

6. Game apparatus according to claim 1 wherein said track means further comprises a second sinuous track within said container and having a concave surface of predetermined width and depth and describing a three-dimensional path extending between two points defined as a second starting point and a second finishing point.

7. Game apparatus according to claim 6 wherein said container further includes a second compartment separated from said first compartment by one of said first compartment's sides, said one side having an aperture therethrough, whereby said first compartment and said second compartment commuinicate with one another through said aperture and wherein second compartment track finishing point communicates with said aperture.

8. Game apparatus according to claim 7 further comprising second compartment receiving means extending between said second track finishing point and said aperture.

9. Game apparatus according to claim 1 wherein said container has a polyhedral shape.

10. Game apparatus according to claim 1 wherein said container has the configuration of a geometric solid of revolution.

11. Game apparatus according to claim 1 wherein at least one surface of said container is substantially opaque.

12. Game apparatus according to claim 11 wherein all externally visible portions of said container are substantially opaque.

13. Game apparatus according to claim 11 wherein all externally visible portions of said container are at least partially transparent, whereby said track means and said ball may be viewed by a person using the game apparatus.

14. Game apparatus according to claim 1 wherein said first sinuous track includes at least one obstacle impeding the movement of said ball therealong.

15. Game apparatus according to claim 14 wherein said obstacle comprises a pivoting member extending transverse to a portion of said track, with the pivot axis of said pivoting member transverse to and intersecting said track, whereby a ball rolling along the track must roll up and over the pivoting member.

16. Game apparatus according to claim 14 wherein said obstacle comprises an aperture through said track, said aperture being slightly larger in diameter than the diameter of said ball, whereby the ball will tend to fall through the aperture as it rolls along the track unless the ball is rolled rapidly past the aperture.

17. Game apparatus according to claim 14 wherein said obstacle comprises a loop in said track, whereby the ball must be caused to move around the loop in order to continue along the track.

18. Game apparatus according to claim 14 wherein said track includes a transversely enlarged portion thereof adjacent said obstacle and between said obstacle and said finishing point, whereby the ball can be caught in the enlarged track portion if the ball is caused to jump over the obstacle.

19. Game aparatus according to claim 1 further comprising a second ball having a predetermined diameter smaller than said diameter of said first ball.

20. Game apparatus according to claim 19 and further comprising a second sinuous track within said first compartment and having a concave cross section and describing a three-dimensional path extending between two points defined as a second starting point and a second finishing point, whereby either of the two balls may roll along either of the two first compartment tracks.

21. Game apparatus according to claim 20 wherein the transverse width of said first compartment second track is less than the transverse width of said first compartment first track such that said second track will provide less support transversely thereof to said first ball than said first track provides to said first ball or than said second track provides to said second ball, whereby the first ball will fall more easily from the second track than from the first track and more easily than the second ball falls from the second track.

22. Game apparatus according to claim 20 wherein said first sinuous track has an aperture therethrough larger in diameter than said second ball diameter.

23. Game apparatus according to claim 22 wherein said aperture through said first track is slightly larger than said first ball diameter.

24. Game apparatus according to claim 1 further comprising an audible signalling means having actuating means positioned adjacent said first track for actuation by the passage thereby along said track of said first ball.

25. Game apparatus according to claim 1 wherein said track means further comprises a tubular portion of said first sinuous track, said tubular portion having an inside diameter larger than said first ball diameter, whereby the first ball in moving along the track means between starting point and the finishing point will pass through the tubular portion.

26. Game apparatus according to claim 25 wherein said track means tubular portion includes a plurality of generally circular apertures through the walls thereof, said apertures each having a diameter larger than said first ball diameter.

27. Game apparatus according to claim 1 wherein said track means comprises substantially rigid portions and at least one non-rigid portion flexible under the weight of said first ball passing therealong, whereby passage of the first ball along the non-rigid portion will effect substantial deflection of that non-rigid track means portion.

* * * * *